US012421851B2

(12) United States Patent
MacFarlane

(10) Patent No.: US 12,421,851 B2
(45) Date of Patent: Sep. 23, 2025

(54) FORMATION TESTING WITH CONTROLLED PRESSURE DRILLING

(71) Applicant: WEATHERFORD TECHNOLOGY HOLDINGS, LLC, Houston, TX (US)

(72) Inventor: Graeme MacFarlane, Aberdeen (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 18/587,016

(22) Filed: Feb. 26, 2024

(65) Prior Publication Data

US 2025/0270928 A1 Aug. 28, 2025

Related U.S. Application Data

(60) Provisional application No. 63/556,684, filed on Feb. 22, 2024.

(51) Int. Cl.
*E21B 49/10* (2006.01)
*E21B 23/06* (2006.01)
*E21B 33/08* (2006.01)

(52) U.S. Cl.
CPC ..... *E21B 49/10* (2013.01); *E21B 23/06* (2013.01); *E21B 33/085* (2013.01)

(58) Field of Classification Search
CPC ..... E21B 49/081; E21B 49/10; E21B 21/103; E21B 34/066
See application file for complete search history.

(56) References Cited

U.S. PATENT DOCUMENTS 3,134,441 A * 5/1964 Adelbert ..... E21B 33/127 166/66.4
4,113,012 A * 9/1978 Evans ..... E21B 34/108 166/321
5,799,733 A * 9/1998 Ringgenberg ..... E21B 33/1243 166/147
5,803,186 A * 9/1998 Berger ..... E21B 49/008 166/264

(Continued)

FOREIGN PATENT DOCUMENTS

AU 2014202119 B 3/2016

OTHER PUBLICATIONS

Leutert, "DST Sampling," product brochure, dated 2017, 4 pages.

(Continued)

*Primary Examiner* — Jennifer H Gay
(74) *Attorney, Agent, or Firm* — Smith IP Services, P.C.

(57) ABSTRACT

A formation testing method can include deploying a drill string including a packer and a circulating tool into a well, setting the packer, thereby blocking fluid flow through an annulus, and opening the circulating tool, thereby permitting fluid communication between the annulus and an interior flow passage of the drill string. The opening step can include displacing a radio frequency identification tag into the circulating tool. A formation testing system can include a drill string with a drill bit, a circulating tool and a packer. The packer is configured to seal off an annulus, and the circulating tool is selectively operable to permit fluid communication between the annulus and an interior flow passage of the drill string in response to a radio frequency identification tag being deployed into the circulating tool.

18 Claims, 8 Drawing Sheets

(56) References Cited

U.S. PATENT DOCUMENTS

| | | | | |
|---|---|---|---|---|
| 6,047,239 | A * | 4/2000 | Berger | E21B 49/08 702/9 |
| 6,157,893 | A * | 12/2000 | Berger | E21B 49/06 702/9 |
| 6,236,620 | B1 * | 5/2001 | Schultz | E21B 33/1275 175/48 |
| 6,622,554 | B2 * | 9/2003 | Manke | E21B 33/124 73/152.55 |
| 7,080,552 | B2 | 7/2006 | Jones et al. | |
| 7,096,976 | B2 * | 8/2006 | Paluch | E21B 21/10 73/152.28 |
| 7,958,936 | B2 | 6/2011 | Mcgregor et al. | |
| 8,210,036 | B2 | 7/2012 | Bekkeheien | |
| 8,833,469 | B2 | 9/2014 | Purkis | |
| 9,970,290 | B2 | 5/2018 | Wilkinson et al. | |
| 10,100,631 | B2 | 10/2018 | Kalyanaraman et al. | |
| 10,871,069 | B2 * | 12/2020 | Adebiyi | E21B 49/008 |
| 11,174,705 | B2 | 11/2021 | Coates et al. | |
| 2002/0178804 | A1 * | 12/2002 | Manke | E21B 49/088 73/152.55 |
| 2003/0141055 | A1 * | 7/2003 | Paluch | E21B 47/06 166/254.2 |
| 2003/0234120 | A1 * | 12/2003 | Paluch | E21B 49/082 175/50 |
| 2011/0284219 | A1 * | 11/2011 | Pomerantz | E21B 49/08 166/264 |
| 2013/0014993 | A1 * | 1/2013 | Jeffries | E21B 49/003 175/50 |
| 2014/0131029 | A1 * | 5/2014 | Harms | E21B 47/06 166/66.4 |
| 2015/0057935 | A1 * | 2/2015 | Wu | E21B 47/06 702/12 |
| 2020/0217197 | A1 * | 7/2020 | Adebiyi | E21B 33/127 |
| 2020/0240265 | A1 | 7/2020 | Machocki et al. | |
| 2021/0071514 | A1 | 3/2021 | Cooley et al. | |
| 2022/0112803 | A1 * | 4/2022 | Elsorsar | E21B 49/081 |

OTHER PUBLICATIONS

Schlumberger, "Energy Glossary: managed pressure drilling," 1 page, undated, accessed Jan. 30, 2024.
Weatherford, "JetStream RFID Circulation Sub," product brochure, dated 2019, 2 pages.
Weatherford, "RFID-Enabled Tools," product brochure, dated 2018, 12 pages.
International Search Report with Written Opinion issued Apr. 2, 2025 for PCT Patent Application No. PCT/IB2025/050897, 9 pages.

* cited by examiner

FORMATION TESTING WITH CONTROLLED PRESSURE DRILLING

CROSS-REFERENCE TO RELATED APPLICATION

This application claims the benefit of the filing date of U.S. provisional application No. 63/556,684, filed on 22 Feb. 2024. The entire disclosure of the prior application is incorporated herein by this reference for all purposes.

BACKGROUND

This disclosure relates generally to equipment utilized and operations performed in conjunction with a subterranean well and, in an example described below, more particularly provides for formation testing with controlled pressure drilling.

Controlled pressure drilling is typically used when drilling through sensitive formations or formations with relatively small differences between pore pressure and fracture pressure. Wellbore pressure is precisely controlled, in part due to the wellbore being isolated from the atmosphere at the surface. This isolation from the atmosphere allows the wellbore to be treated as a "closed" fluid system, with controlled inputs and outputs. Various types of controlled pressure drilling include managed pressure drilling (in which wellbore pressure is maintained just greater than pore pressure, but less than fracture pressure) and under balanced drilling (in which wellbore pressure is maintained just less than pore pressure).

It will be appreciated that improvements are continually needed in the art of controlled pressure drilling. This specification provides such improvements, which may be used in a variety of different types of drilling operations.

DETAILED DESCRIPTION

Figure 1:
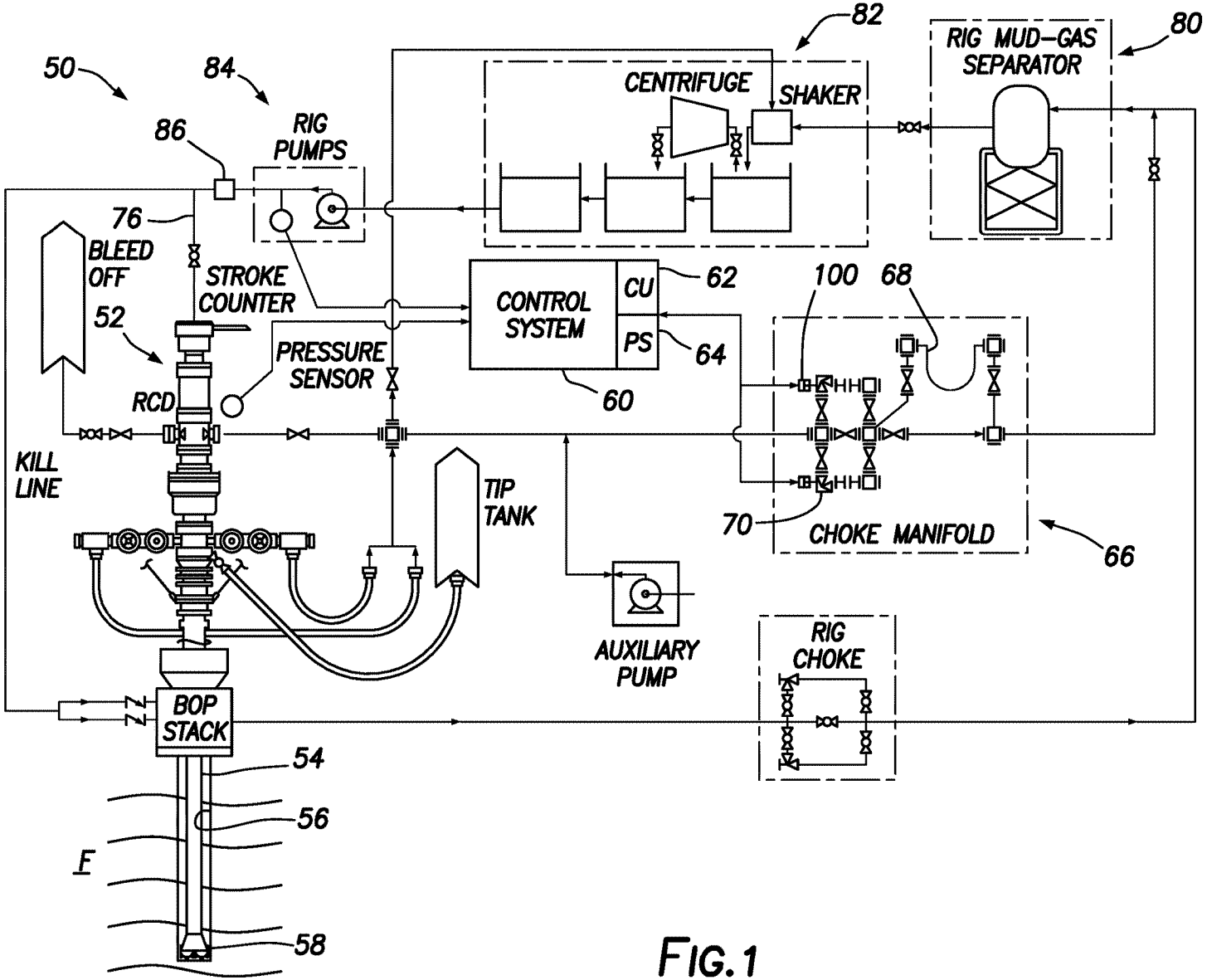
FIG. 1 is a representative partially cross-sectional view of an example of a well system and associated method which can embody principles of this disclosure.

Representatively illustrated in FIG. 1 is a drilling system 50 and associated method which can embody principles of this disclosure. However, it should be clearly understood that the system 50 and method are merely one example of an application of the principles of this disclosure in practice, and a wide variety of other examples are possible. Therefore, the scope of this disclosure is not limited at all to the details of the system 50 and method described herein and/or depicted in the drawings.

In the FIG. 1 example, the drilling system 50 is adapted for controlled pressure drilling. As shown and discussed herein, this system 50 can be a managed pressure drilling (MPD) system and, more particularly, a constant bottomhole pressure (CBHP) form of MPD system. Although discussed in this context, the teachings of the present disclosure can apply equally to other types of controlled pressure drilling systems, such as other MPD systems (e.g., pressurized mud-cap drilling, returns-flow-control drilling, dual gradient drilling, etc.) as well as to under balanced drilling (UBD) systems, and to other types of drilling systems, as will be appreciated by one skilled in the art having the benefit of the present disclosure.

The drilling system 50 has a rotating control device (RCD) 52 from which a drill string 54, a bottom hole assembly (BHA), and a drill bit 58 extend downhole in a wellbore 56 through a formation F. The rotating control device 52 can include any suitable pressure containment device (such as annular seals) that keeps the wellbore 56 "closed" or isolated from the atmosphere at the surface at all times while the wellbore is being drilled.

The system 50 also includes a standpipe 76, rig pumps 84, mud tanks 82, a mud gas separator 80, and various flow lines, as well as other conventional components. In addition to these, the drilling system 50 includes an automated choke manifold 66 that is incorporated into the other components of the system 50, such as a control system 60 having a control unit 62 and a power source 64.

The control system 60 integrates hardware, software, and applications across the drilling system 50 and is used for monitoring, measuring, and controlling parameters in the drilling system 50. In this contained environment of the closed wellbore 56, for example, minute fluid influxes or losses are detectable at the surface, and the control system 60 can further analyze pressure and flow data to detect kicks, losses, and other events. At least some operations of the drilling system 50 can be automatically controlled by the control system 60 (for example, to appropriately respond to a fluid influx or loss).

To monitor operations, the control system 60 can use data from a number of sensors and devices in the system 50. For example, one or more sensors can measure pressure in the standpipe 76. One or more sensors (i.e., stroke counters) can measure the speed of the rig pumps 84 for deriving the flow rate of drilling fluid into the drill string 54.

In this way, flow into the drill string 54 may be determined from strokes-per-minute and/or standpipe pressure measurements. Alternatively, a flowmeter 86, such as a Coriolis flowmeter downstream of the rig pumps 84, can also be used to measure flow into the wellbore 56.

One or more sensors can measure the volume of fluid in the mud tanks 82 and the rate of flow into and out of the mud tanks. A change in mud tank level can indicate a change in drilling fluid volume. Flow out of the wellbore 56 may be determined from the drilling fluid volume entering the mud tanks 82.

The fluid data and other measurements noted herein can be transmitted to the control system 60, which can in turn control drilling functions. In particular, the control system 60 can use the control unit 62 and power source 64 to operate the automated choke manifold 66, which manages pressure and flow during drilling and is incorporated into the drilling system 50 downstream from the rotating control device 52 and upstream of the mud-gas separator 80.

Among other components, the manifold 66 has chokes 70, a flowmeter 68, pressure sensors (not shown), and other components. The control unit 62 controls operation of the manifold 66 and the power source 64 (e.g., a hydraulic power unit and/or electric motor) actuates the chokes 70 in this example.

During drilling operations, the system 50 uses the rotating control device 52 to keep the well closed to the atmosphere. Fluid leaving the wellbore 56 flows through the automated choke manifold 66, which measures return flow (e.g., flow-out) and density using a flowmeter 68 installed in line with the chokes 70.

Software components of the control system 60 compare the flow rate in and out of the wellbore 56, the injection pressure (or standpipe pressure), the surface back pressure (measured upstream from the drilling chokes 70), the position of the chokes 70, and the mud density, among other possible variables. Comparing these variables, the control system 60 then identifies downhole influxes and losses on a real-time basis to manage the wellbore pressure during drilling.

By identifying the downhole influxes and losses during drilling, for example, the control system 60 monitors circulation to maintain balanced flow for relatively constant bottom hole pressure under operating conditions, and to detect kicks and lost circulation events that jeopardize that balance. The drilling fluid is continuously circulated through the system 50, choke manifold 66, and the Coriolis flowmeter 68. As will be appreciated, the chokes 70 may fluctuate during normal operations due to noise, sensor errors, etc., so that the control system 60 can be calibrated to accommodate such fluctuations.

In any event, the control system 60 measures the flow-in and flow-out of the well, detects variations, and operates the chokes 70 to account for the variations. In general, if the flow-out is higher than the flow-in, then fluid is being gained in the drilling system 50, indicating a kick or influx. By contrast, if the flow-out is lower than the flow-in, then drilling fluid is being lost to the formation F, indicating lost circulation.

To control wellbore pressure, the control system 60 introduces pressure and flow changes to the drilling fluid at the surface to change the pressure profile in the wellbore 56. To do this, the control system 60 uses the chokes 70 in the choke manifold 66 to apply surface back pressure to the wellbore 56, which produces a corresponding change in bottomhole pressure. In this way, the control system 60 uses real-time flow and pressure data and manipulates the back pressure to manage or mitigate fluid influxes and losses.

In the control process, the control system 60 uses internal algorithms to identify what event is occurring downhole, and reacts automatically. For example, the control system 60 monitors for any deviations from desired values during drilling operations, and alerts operators of any problems that might be caused by a fluid influx into the wellbore 56 from the formation F or a loss of drilling fluid into the formation F. In addition, the control system 60 can automatically detect, control, and circulate out such influxes and losses by operating the chokes 70 of the choke manifold 66 and performing other automated operations.

Figure 2:
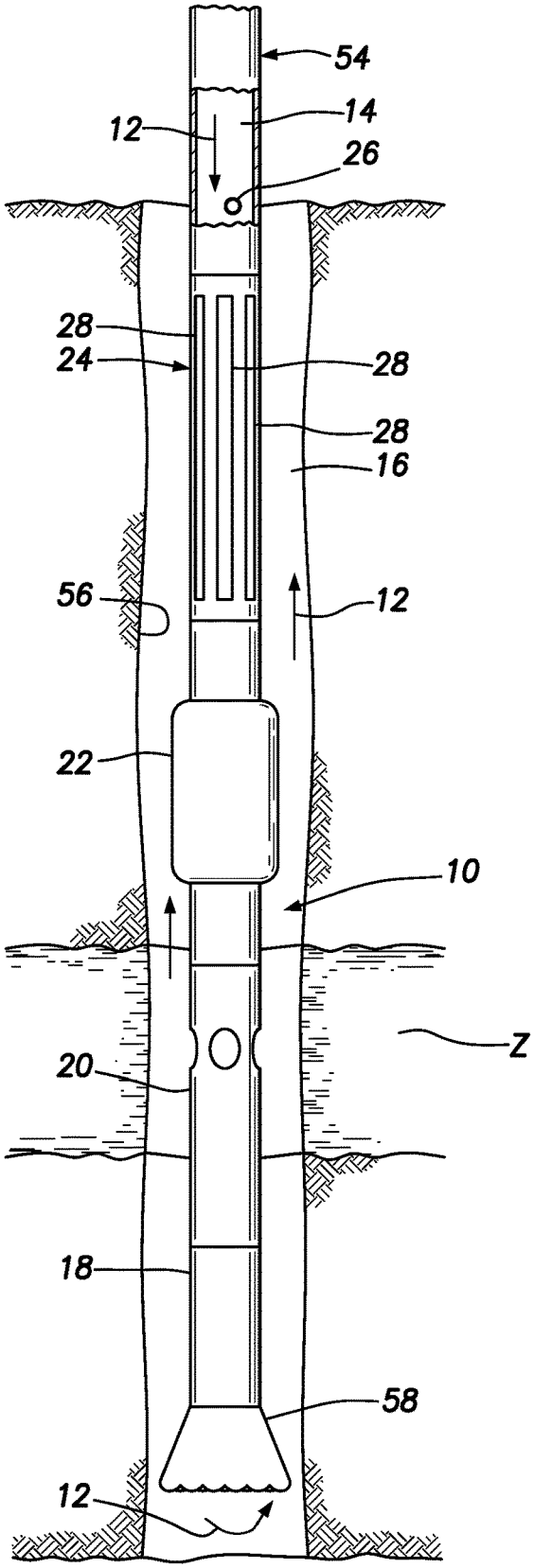
FIG. 2 is a representative partially cross-sectional view of an example of a formation testing method and system that may be used with the FIG. 1 system and method, in which a controlled pressure drilling operation is being performed.

Referring additionally now to FIG. 2, a partially cross-sectional view of an example of a formation testing system 10 is representatively illustrated. The FIG. 2 formation testing system 10 may be used with the FIG. 1 drilling system 50, or it may be used with other types of drilling systems. For convenience, the formation testing system 10 is described below as it may be used with the FIG. 1 drilling system 50.

As depicted in FIG. 2, the drill string 54 has been deployed into the wellbore 56. The drill string 54 may be used to drill the wellbore 56, so that it penetrates (either fully or partially) a zone of interest Z. While drilling, and at other times in the drilling operation, a drilling fluid 12 is flowed from the surface through an interior flow passage 14 of the drill string 54, out of nozzles of the drill bit 58, and back to the surface via an annulus 16 formed between the drill string 54 and the wellbore 56.

In the FIG. 2 example, the drill string 54 includes the drill bit 58, an assembly of drilling tools 18 (including, for example, a fluid motor, logging tools, etc.), a circulating tool 20, a packer 22 and a fluid sampler 24. The flow passage 14 extends longitudinally through the drilling tools 18, the circulating tool 20, the packer 22 and the fluid sampler 24, and can be considered to extend through the nozzles in the drill bit 58.

It is desired in this example to perform a formation test on the zone of interest Z. In a typical formation test, pressure adjacent a zone is reduced (known as a "drawdown"), and then the pressure is allowed to increase (known as a "buildup") due to the zone's pore pressure. Measured pressure levels and rates of drawdown and buildup can be analyzed to determine the zone's estimated future productivity. A sample of fluid from the zone may also be taken for later laboratory analysis of the fluid's composition. However, the scope of this disclosure is not limited to any particular type of formation test performed, or to the collection of a formation fluid sample in conjunction with a formation test.

In the FIG. 2 example, the circulating tool 20 is used to selectively prevent and permit fluid communication between the flow passage 14 and the annulus 16. As depicted in FIG. 2, the circulating tool 20 is closed, as it would be while drilling. The circulating tool 20 is connected in the drill string 54 between the packer 22, and the drill bit 58 and drilling tools 18.

The circulating tool 20 is operable by displacing a radio frequency identification (RFID) tag 26 into the circulating tool. For example, the RFID tag 26 may be displaced with the drilling fluid 12 through the flow passage 14. However, the scope of this disclosure is not limited to any particular technique used to displace the RFID tag 26 into the circulating tool 20.

The circulating tool 20 includes an interrogator (not shown) that can detect the presence of the RFID tag 26 in the circulating tool. When the presence of the RFID tag 26 is detected, an actuator (not shown) of the circulating tool 20 shifts the tool from its closed configuration (as depicted in FIG. 2) to its open configuration (see FIG. 3).

The packer 22 in this example is an open hole packer capable of sealing against an inner wall of the wellbore 56. Suitable open hole packers may include inflatable or compression-set packers. However, the scope of this disclosure is not limited to use of any particular type of packer in the formation testing system 10.

The fluid sampler 24 is connected uphole of the packer 22 in the FIG. 2 example. The fluid sampler 24 may be connected downhole of the packer 22 in other examples.

The fluid sampler 24 may include multiple sample chambers 28 for collecting samples of formation fluid. Valves (not shown) selectively prevent and permit fluid communication between the flow passage 14 and an interior of each of the sample chambers 28. In some examples, the fluid sampler 24 can include pressure and/or temperature memory gauges (not shown).

In this example, the valves are each operable in response to an RFID tag being displaced into the fluid sampler 24. As described more fully below, the RFID tag used to operate the fluid sampler 24 may be different from the RFID tag 26 used to open the circulating tool 20.

Figure 3:
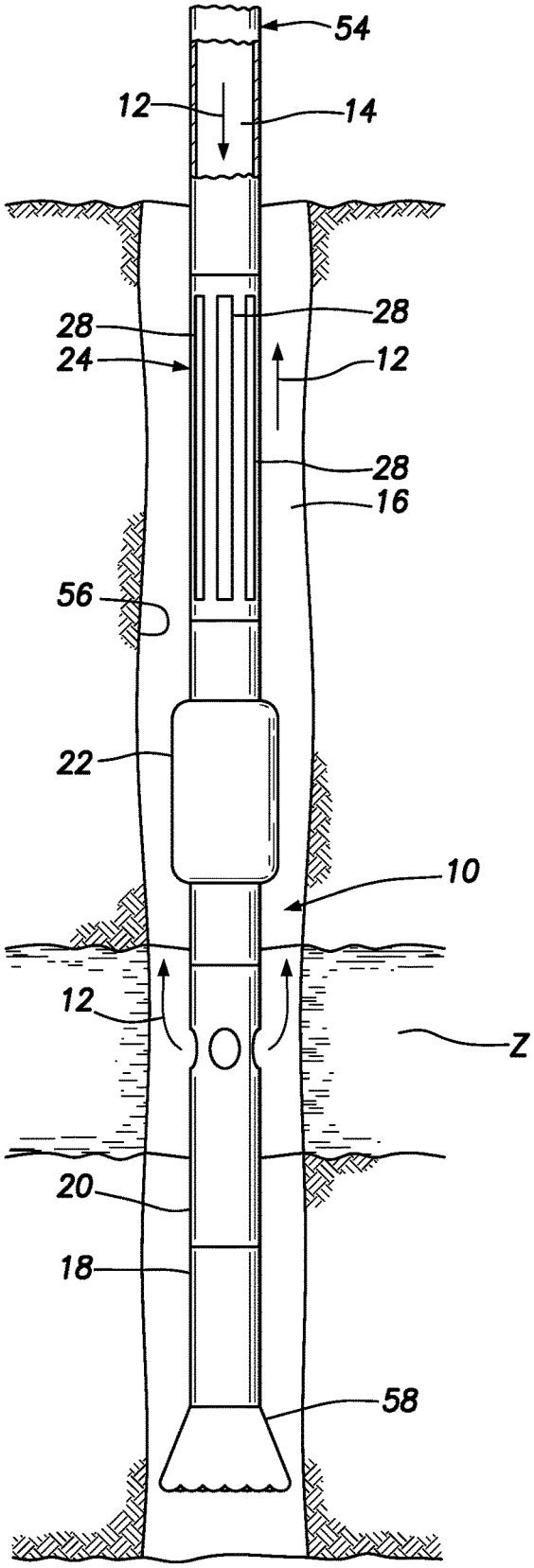
FIG. 3 is a representative partially cross-sectional view of the FIG. 2 method and system, in which a circulating tool has been opened.

Referring additionally now to FIG. 3, the formation testing system 10 is representatively illustrated after the RFID tag 26 (see FIG. 2) has been displaced into the circulating tool 20 to thereby open the circulating tool. Fluid communication is now permitted between the interior flow passage 14 and the annulus 16.

Figure 4:
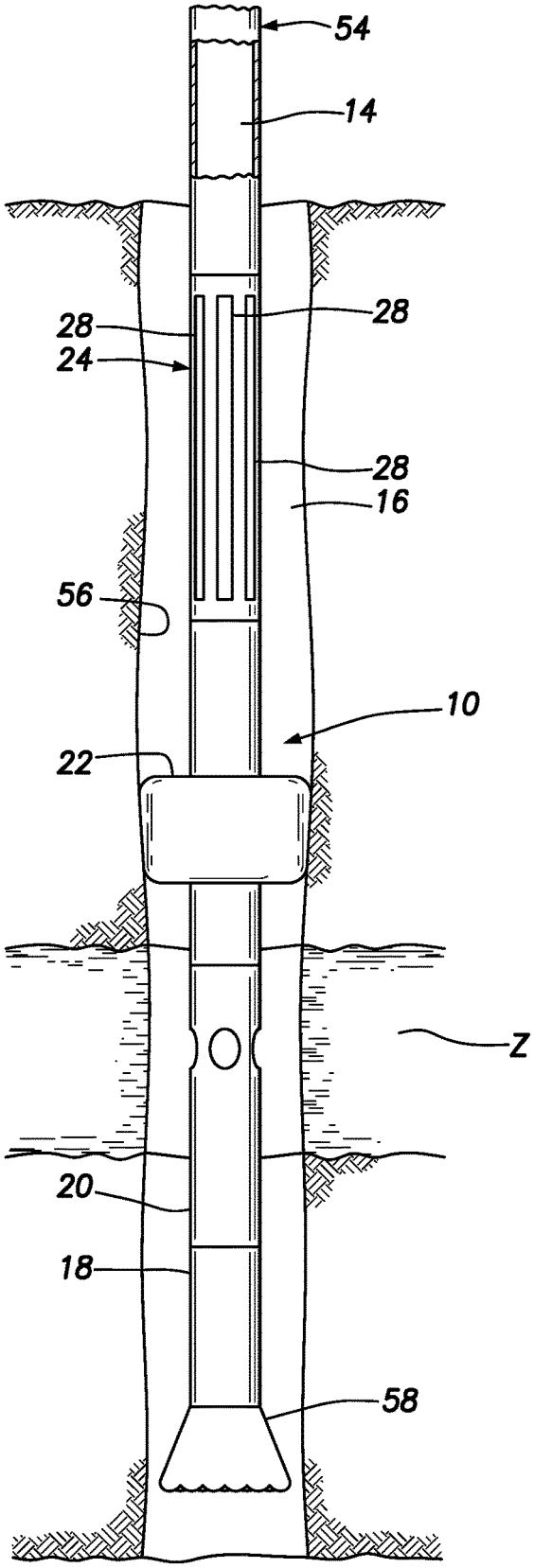
FIG. 4 is a representative partially cross-sectional view of the FIG. 2 method and system, in which a packer has been set.

Referring additionally now to FIG. 4, the formation testing system 10 is representatively illustrated after the packer 22 has been set. Fluid communication is now blocked in the annulus 16 at the packer 22.

The packer 22 seals off the annulus 16 uphole of the packer from the annulus downhole of the packer. However, the annulus 16 downhole of the packer 22 (and the zone of interest Z) remains in fluid communication with the flow passage 14 via the open circulating tool 20.

Figure 5:
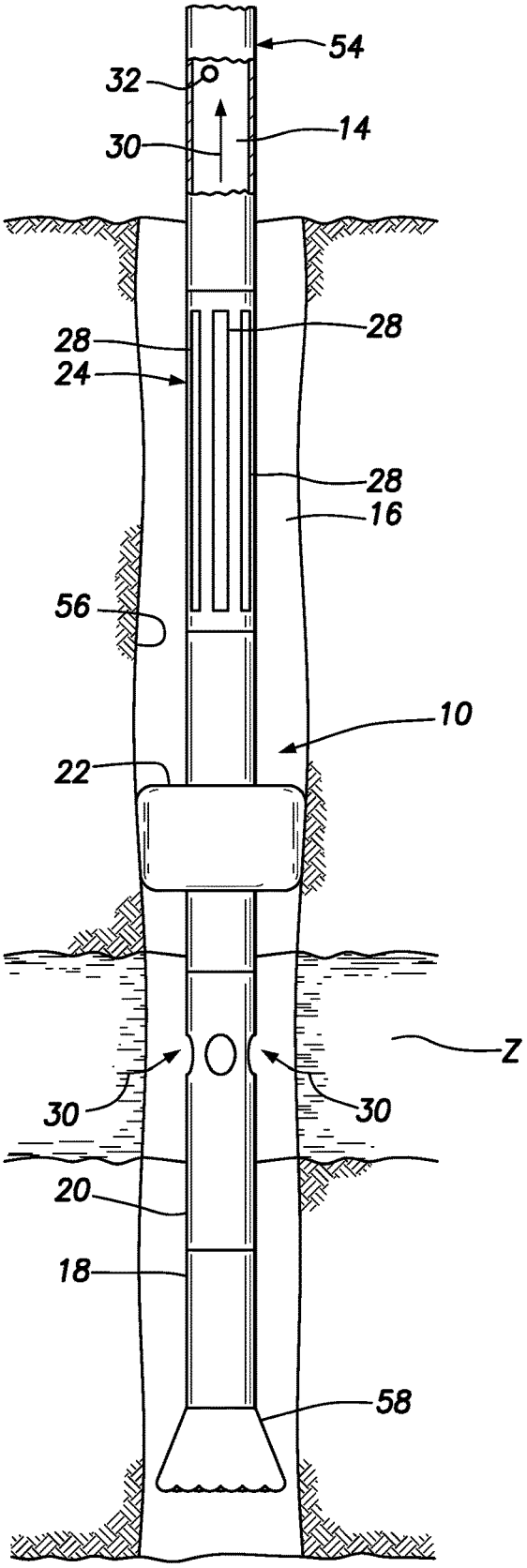
FIG. 5 is a representative partially cross-sectional view of the FIG. 2 method and system, in which fluids are produced from a zone.

Referring additionally now to FIG. 5, the formation testing system 10 is representatively illustrated after formation fluid 30 has been flowed from the zone of interest Z into the flow passage 14 via the open circulating tool 20. The fluid 30 (e.g., including one or more of oil, gas, water and gas condensates) may be induced to flow into the flow passage 14 by, for example, reducing pressure in the flow passage 14 so that, in the annulus 16 at the zone of interest Z, the pressure is less than the pore pressure in the zone of interest.

This can be considered the drawdown phase of a formation test, after which the flow of the fluid 30 into the drill string 54 can be ceased to allow for a buildup of pressure. Sensors of the drilling tools 18 can measure, record and communicate (in some cases) parameters such as temperature and pressure during the formation test. Surface sensors (such as, pressure sensors and flowmeters) can also measure, record and communicate parameters during the formation test.

When it is desired to take a sample of the fluid 30, another RFID tag 32 can be deployed into the flow passage 14, preferably after the flow of the fluid 30 has ceased. The RFID tag 32 will displace into the fluid sampler 24 where an interrogator (not shown) will detect the presence of the RFID tag. In response, one or more of the valves of the fluid sampler 24 will open.

Figure 6:
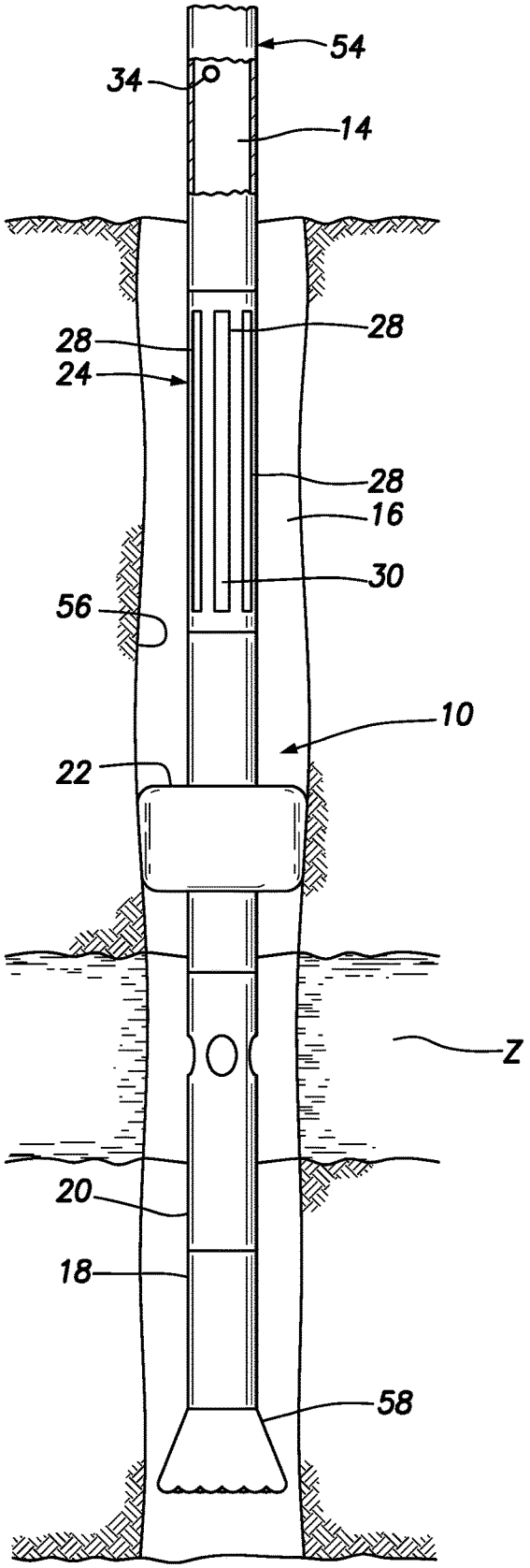
FIG. 6 is a representative partially cross-sectional view of the FIG. 2 method and system, in which a fluid sampler tool has been actuated.

Referring additionally now to FIG. 6, the formation testing system 10 is representatively illustrated after the RFID tag 32 has been displaced into the fluid sampler 24. One or more of the valves of the fluid sampler 24 have been thereby opened, allowing the fluid 30 to flow from the flow passage 14 into one or more respective sample chambers 28. In this example, the open valve(s) close a predetermined amount of time after they have been opened.

When the formation testing and fluid sampling operations are complete, the drill string 54 can be retrieved from the wellbore 56, or it may be used to continue drilling. Another RFID tag 34 can be deployed into the flow passage 14 to close the circulating tool 20. The RFID tag 34 will displace into the circulating tool 20 and, in response, fluid communication between the flow passage 14 and the annulus 16 via the circulating tool will be prevented.

Figure 7:
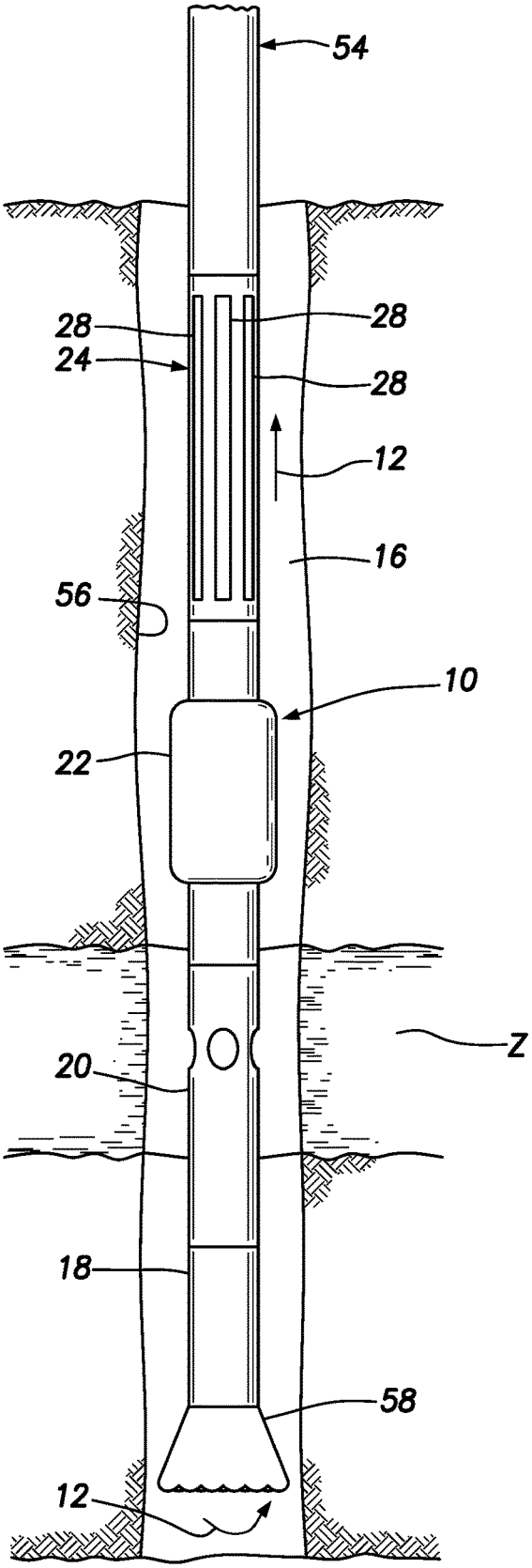
FIG. 7 is a representative partially cross-sectional view of the FIG. 2 method and system, in which the packer has been unset and the circulating tool has been closed.

Referring additionally now to FIG. 7, the formation testing system 10 is representatively illustrated after the circulating tool 20 has been closed by displacing the RFID tag 34 into the circulating tool. In addition, the packer 22 has been unset. The packer 22 may be unset prior to, or after, the circulating tool 20 has been closed.

As depicted in FIG. 7, the drill string 54 may be used to further drill the wellbore 56 (for example, to penetrate another zone of interest), or the drill string may be retrieved to the surface (for example, to access and analyze the samples of fluid 30).

Figure 8:
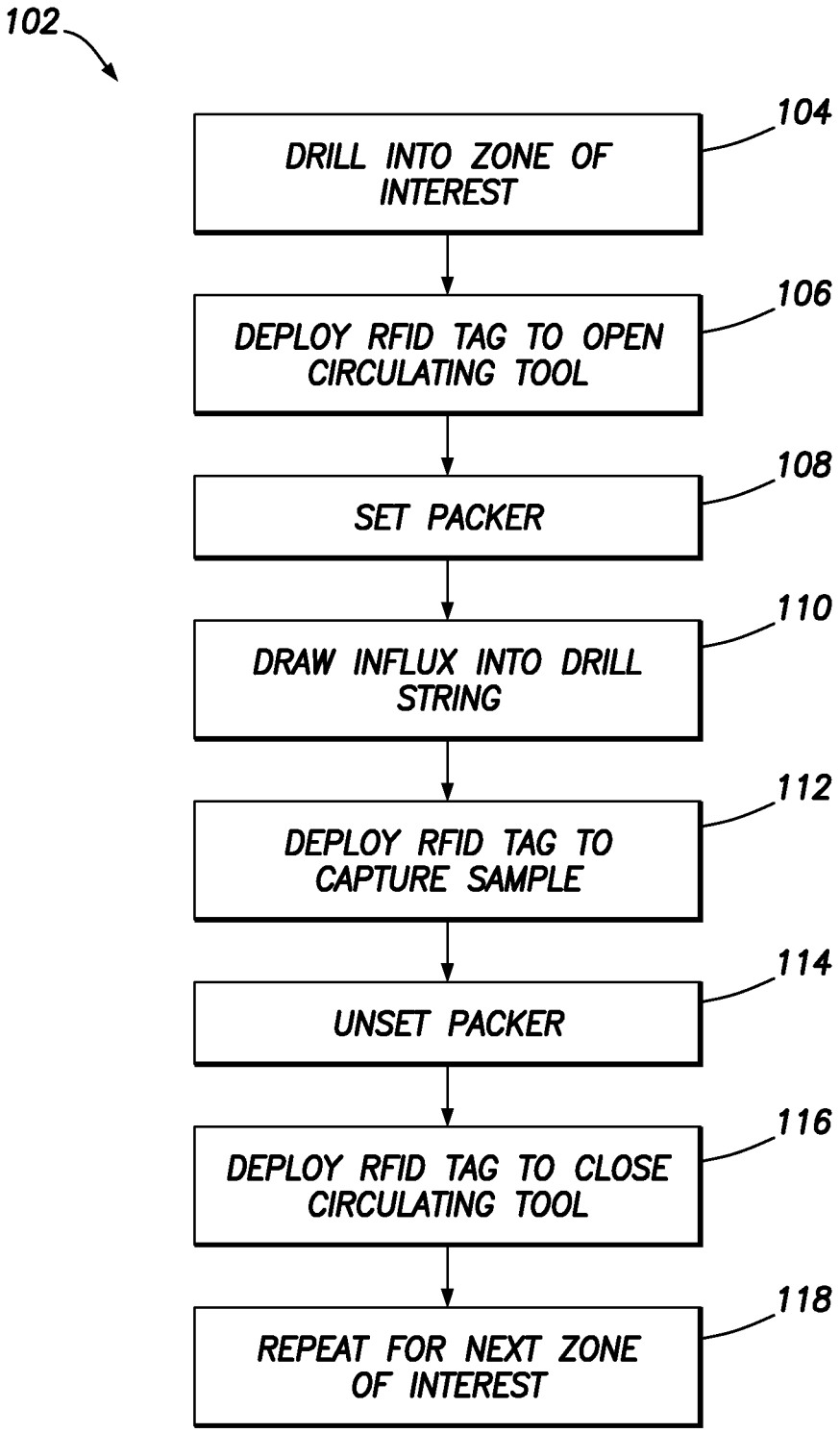
FIG. 8 is a representative flowchart for an example formation testing method.

Referring additionally now to FIG. 8, a flowchart for an example formation testing method 102 is representatively illustrated. The FIG. 8 method 102 may be used with the FIGS. 2-8 formation testing system 10, or it may be used with other systems. For convenience, the method 102 is described below as it may be used with the FIGS. 2-8 formation testing system 10.

In an initial step 104, the zone of interest Z is penetrated by the wellbore 56, preferably in a controlled pressure drilling operation, in which the annulus 16 is isolated from the atmosphere at the surface. The drill string 54 is used to drill into the zone of interest Z.

The drill string 54 can include the drill bit 58, the circulating tool 20 and the packer 22, with the circulating tool connected between the drill bit and the packer. In some examples the drill string 54 can also include a variety of drilling tools 18 and/or the fluid sampler 24.

In step 106, the circulating tool 20 is opened by displacing an RFID tag 26 into the circulating tool. When opened, the circulating tool 20 permits fluid communication between the annulus 16 and the flow passage 14 via the circulating tool.

In step 108, the packer 22 is set. The packer 22 may be set prior to, or after, the circulating tool 20 is opened (step 106). That is, step 108 may be performed prior to step 106.

In step 110, an influx of formation fluid 30 is drawn into the drill string 54 via the open circulating tool 20. The formation fluid 30 may be induced to flow into the drill string 54 by reducing pressure in the drill string until there is a positive pressure differential from the zone of interest Z to the flow passage 14 (e.g., the pore pressure in the zone of interest is greater than pressure in the flow passage 14).

In step 112, the RFID tag 32 is displaced into the fluid sampler 24. This causes the fluid 30 to flow from the flow passage 14 into one or more of the sample chambers 28. In this example, the opened sample chamber(s) 28 will automatically close a certain amount of time after being opened.

In step 114, the packer 22 is unset. By unsetting the packer 22, the drill string 54 is again able to move relatively freely in the wellbore 56 and the annulus 16 is completely open to the surface.

In step 116, the circulating tool 20 is closed by displacing the RFID tag 34 into the circulating tool. Fluid communication between the flow passage 14 and the annulus 16 via the circulating tool 20 is now prevented. Note that step 116 may in some examples be performed prior to step 114.

In step 118, the previous steps 104-116 can be repeated for another zone of interest Z. Any number of zones can be drilled into and tested using the system 10 and/or method 102.

It may now be appreciated that the above disclosure provides significant advancements to the art of controlled pressure drilling with formation testing. In examples described above, the same drill string 54 can be used to drill the wellbore 56 and test the zone of interest Z in a controlled pressure drilling operation.

The above disclosure provides to the art a formation testing method 102 for use with a subterranean well. In one example, the method 102 can include: deploying a drill string 54 into the well, the drill string 54 comprising a packer 22 and a circulating tool 20; setting the packer 22 in a wellbore 56 of the well, thereby blocking fluid flow through an annulus 16 formed between the drill string 54 and the wellbore 56; and opening the circulating tool 20, thereby permitting fluid communication between the annulus 16 and an interior flow passage 14 of the drill string 54. The opening step includes displacing a first radio frequency identification tag 26 into the circulating tool 20.

The method 102 may include flowing a formation fluid 30 from a zone Z penetrated by the wellbore 56 into the interior flow passage 14 after the opening of the circulating tool 20. The flowing step may include reducing pressure in the interior flow passage 14 to thereby draw the formation fluid 30 into the interior flow passage 14.

The method 102 may include drilling the wellbore 56 to penetrate a zone Z, the drilling being performed after the drill string 54 deploying step and prior to the circulating tool 20 opening step. The annulus 16 may be isolated from atmosphere during the drilling step.

The drill string 54 may include a fluid sampler 24 including a sample chamber 28. The method 102 may include flowing a formation fluid 30 from a zone Z penetrated by the wellbore 56 into the sample chamber 28 after the circulating tool 20 opening step. The flowing step may include displacing a second radio frequency identification tag 32 into the fluid sampler 24.

The method 102 may include displacing a third radio frequency identification tag 34 into the circulating tool 20, thereby closing the circulating tool 20. The method 102 may include unsetting the packer 22 prior to the circulating tool 20 closing step.

The circulating tool 20 opening step may be performed prior to the packer 22 setting step.

Also provided to the art by the above disclosure is a formation testing system 10 for use with a subterranean well. In one example, the system 10 can comprise: a drill string 54 configured to drill a wellbore 56 of the well, the drill string 54 comprising a drill bit 58, a circulating tool 20 and a packer 22. The packer 22 is configured to seal off an annulus 16 formed between the drill string 54 and the wellbore 56, and the circulating tool 20 is selectively operable to permit fluid communication between the annulus 16 and an interior flow passage 14 of the drill string 54 in response to a first radio frequency identification tag 26 being deployed into the circulating tool 20.

The annulus 16 may be isolated from atmosphere at a surface of the well.

The drill string 54 may include a fluid sampler 24 with a sample chamber 28. The packer 22 may be connected in the drill string 54 between the fluid sampler 24 and the circulating tool 20.

The fluid sampler 24 may be selectively operable to permit fluid flow into the sample chamber 28 in response to a second radio frequency tag 32 being deployed into the fluid sampler 24. The circulating tool 20 may be selectively operable to prevent fluid communication between the annulus 16 and the interior flow passage 14 of the drill string 54 in response to a third radio frequency identification tag 34 being deployed into the circulating tool 20.

The sample chamber 28 may be configured to close a predetermined amount of time after the sample chamber 28 is opened in response to the deployment of the second radio frequency identification tag 32.

The system 10 may include a rotating control device 52 that seals off the annulus 16 at a surface of the well.

The circulating tool 20 may be connected in the drill string 54 between the drill bit 58 and the packer 22. The packer 22 may be an open hole packer configured to seal against a wall of the wellbore 56.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A formation testing method for use with a subterranean well, the method comprising:

deploying a drill string into the well, the drill string comprising a packer and a circulating tool;

setting the packer in a wellbore of the well, thereby blocking fluid flow through an annulus formed between the drill string and the wellbore; and opening the circulating tool, thereby permitting fluid communication between the annulus and an interior flow passage of the drill string, the opening comprising displacing a first radio frequency identification tag into the circulating tool, in which the circulating tool opening is performed prior to the packer setting.

2. The method of claim 1, further comprising flowing a formation fluid from a zone penetrated by the wellbore into the interior flow passage after the opening of the circulating tool.

3. The method of claim 2, in which the flowing comprises reducing pressure in the interior flow passage to thereby draw the formation fluid into the interior flow passage.

4. The method of claim 1, further comprising drilling the wellbore to penetrate a zone, the drilling being performed after the drill string deploying and prior to the circulating tool opening.

5. The method of claim 4, in which the annulus is isolated from atmosphere during the drilling.

6. The method of claim 1, in which the drill string further comprises a fluid sampler including a sample chamber, and further comprising flowing a formation fluid from a zone penetrated by the wellbore into the sample chamber after the circulating tool opening.

7. The method of claim 6, in which the flowing comprises displacing a second radio frequency identification tag into the fluid sampler.

8. The method of claim 7, further comprising displacing a third radio frequency identification tag into the circulating tool, thereby closing the circulating tool.

9. The method of claim 8, further comprising unsetting the packer prior to the circulating tool closing.

10. A formation testing system for use with a subterranean well, the system comprising:

a drill string configured to drill a wellbore of the well, the drill string comprising a drill bit, a circulating tool, a fluid sampler and a packer, in which the packer is connected in the drill string between the fluid sampler and the circulating tool, the packer being configured to seal off an annulus formed between the drill string and the wellbore, and the circulating tool being selectively operable to permit fluid communication between the annulus and an interior flow passage of the drill string in response to a first radio frequency identification tag being deployed into the circulating tool.

11. The system of claim 10, in which the annulus is isolated from atmosphere at a surface of the well.

12. The system of claim 10, in which the fluid sampler includes a sample chamber.

13. The system of claim 12, in which the fluid sampler is selectively operable to permit fluid flow into the sample chamber in response to a second radio frequency tag being deployed into the fluid sampler.

14. The system of claim 13, in which the circulating tool is selectively operable to prevent fluid communication between the annulus and the interior flow passage of the drill string in response to a third radio frequency identification tag being deployed into the circulating tool.

15. The system of claim 13, in which the sample chamber is configured to close a predetermined amount of time after the sample chamber is opened in response to the deployment of the second radio frequency identification tag.

16. The system of claim 10, further comprising a rotating control device that seals off the annulus at a surface of the well.

17. The system of claim 10, in which the circulating tool is connected in the drill string between the drill bit and the packer.

18. The system of claim 17, in which the packer comprises an open hole packer configured to seal against a wall of the wellbore.

* * * * *